US005277573A

United States Patent [19]

Sullivan

[11] Patent Number: 5,277,573

[45] Date of Patent: Jan. 11, 1994

[54] APPARATUS FOR FABRICATING PRECAST CONCRETE RAMPS

[76] Inventor: Thomas Sullivan, 74 Hubbard St., Lenox, Mass. 01240

[21] Appl. No.: 33,008

[22] Filed: Mar. 18, 1993

[51] Int. Cl.[5] ..... B28B 7/16; B28B 7/22; B28B 7/26

[52] U.S. Cl. ..... 425/437; 249/2; 249/16; 249/18; 249/63; 249/66.1; 249/142; 249/144; 249/155; 249/160; 249/188

[58] Field of Search ..... 249/16, 2, 18, 139, 249/142, 155, 156, 160, 161, 187.1, 188, 66.1, 144, 63, 13, 6; 425/444, 454, 63

[56] References Cited

U.S. PATENT DOCUMENTS

| | | | |
|---|---|---|---|
| 1,452,665 | 4/1923 | Tindall | 249/144 |
| 1,493,475 | 5/1924 | Cook | 52/175 |
| 1,717,676 | 6/1929 | Garvin et al. | 249/144 |
| 3,539,146 | 11/1970 | Smith | 249/144 |
| 3,870,777 | 3/1975 | Jakel | 264/71 |
| 3,939,234 | 2/1976 | Dashew | 425/437 |
| 3,977,646 | 8/1976 | Moon et al. | 249/139 |
| 4,181,485 | 1/1980 | Schramm | 425/88 |
| 4,451,022 | 5/1984 | Sauger | 249/2 |
| 4,569,500 | 2/1986 | Beede | 249/13 |
| 4,800,694 | 1/1989 | Sasaki | 52/175 |
| 5,177,913 | 1/1993 | Erel | 52/79.1 |

OTHER PUBLICATIONS

Specification For E-Z Ramps, 1991.

*Primary Examiner*—Khanh Nguyen
*Attorney, Agent, or Firm*—Richard H. Kosakowski

[57] ABSTRACT

A ramp for the physically challenged includes three different types of sectional portions: a slab disposed at the interface of a level surface such as a floor or earth ground; one or more ramp portions, each having a sloping upper surface, disposed adjacent to one another; and a switch platform having a level upper surface. Forms used to fabricate the three different types of sections are provided. A form for fabricating the sloping ramp portion includes a bulkhead, outer panels, and a set of inserts having varying height. The inserts are used to vary the resulting depth of the side panels of the concrete ramp portions. An upper surface of the bulkhead is sloped downwardly in a plane parallel to that of the upper surface of the concrete ramp portion. Apparatus is provided to elevate the front portion of the assembled form so as to place the upper surface of the bulkhead in a horizontal plane that is parallel to the plane of the level surface upon which the form rests.

14 Claims, 4 Drawing Sheets

APPARATUS FOR FABRICATING PRECAST CONCRETE RAMPS

BACKGROUND OF THE INVENTION

This invention relates to precast concrete ramps, and more particularly to precast concrete ramps designed to aid the travel of the physically challenged, along with the forms used to fabricate such ramps.

In the prior art of ramps for the physically challenged, it is known to fabricate the ramps from materials such as timber, metal (e.g., aluminum) or poured concrete. These ramps are intended to aid the physically challenged in their travel either into or out of, or within buildings. The ramps remove architectural, physical and transportational barriers that prevent a business or public building from being accessible to, or usable by, individuals with physical disabilities.

The problems with prior-art ramps fabricated from such materials include the relatively high cost of installation of poured concrete ramps, along with the fact that such ramps are permanently installed, thus making their moving or retrofitting, if ever desired, difficult. Also, timber and metal ramps may deteriorate over time, necessitating their replacement. As these materials deteriorate, they may pose a hazard to travelers.

Regarding public buildings, the Americans with Disabilities Act ("ADA") was signed into law on Jul. 26, 1990. Title III of the ADA (42 U.S.C. §12181 et seq.), regarding Public Accommodations (effective Jan. 26, 1992), requires existing buildings and new buildings to be constructed, to provide ramps for access by the physically challenged to/from or within public buildings. The ADA also specifies certain requirements for features of the ramps. For example, the slope of the ramps must not exceed a one-inch rise for every twelve inches of length. The width of the ramp shall not be less than forty-eight inches as measured at the inside of the railings. Also, each ramp shall have level platforms for turning and resting, which shall be forty-eight inches minimum on a side in clearance, and unobstructed by door swings, entrances, or other projections. Such platforms shall occur at intervals of sloping ramp sections not exceeding thirty-two feet, wherever a ramp changes direction, and at the top and bottom of the ramp.

Many buildings are currently not in compliance with the ADA. In choosing a ramp to meet the requirements of the ADA, factors to be considered include the cost and time of installation, the amount of site excavation required, the amount of disruption to the public and the entities conducting business within the buildings, and the permanence of such ramp structures.

In light of these factors, poured concrete ramps are undesirable. Poured concrete ramps are taken to mean those ramps fabricated by first assembling a form at the exact intended location of the ramp, mixing concrete and pouring it into the form, and then removing the form once the concrete has hardened. Also, timber and metal may be difficult to adapt to existing building designs, and also may be aesthetically unattractive. Further, in order for timber ramps to meet ADA requirements, they need continual maintenance. For example, depending upon the amount of usage, approximately every other year the surface of a timber ramp over which persons traverse must be either painted with a sand paint or the applied non-skid surface must be replaced.

It is known in the art to provide prefabricated concrete ramps. Such ramps are fabricated off-site and transported to the site for assembly. An example of these ramps are those provided by E-Z Ramp of Beverly, Mass. Such ramps have a concrete slab for travel thereupon. The slab is elevated off the ground and supported by vertically-oriented steel pipes which extend above the top surface of the slab to serve also as guardrails. However, the integrity of the interface between the concrete slab and the steel pipes of these ramps may deteriorate over time due to oxidation, thereby posing a hazard. Also, since the steep pipes are each supported by individual steel base plates, the ramp may be prone to instability (i.e., movement) due to, e.g., frost heaves.

Accordingly, it is the primary object of the present invention to provide an improved prefabricated (i.e., "precast") concrete ramp and a method and apparatus for making such ramp.

It is a general object of the present invention to provide a precast concrete ramp that is easily installable with minimal disturbance to existing buildings and with little or no site excavation required.

It is yet another object of the present invention to provide a precast concrete ramp that is sectional in form, thereby allowing for easy adaptability to different overall ramp configurations and for removal and reuse, if desired.

It is still another general object of the present invention to provide a precast concrete ramp that is manufactured off-site using novel and efficient manufacturing forms and techniques.

It is still another object of the present invention to provide a prefabricated concrete ramp that provides for cost-effective compliance with the ADA, and is of low cost relative to poured concrete ramps.

It is still another object of the present invention to provide a precast concrete ramp that is impervious to weather and will not rot or decay over time.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented a precast concrete ramp that is modular or sectional in construction, along with a method and apparatus for fabricating such ramp sections.

In accordance with a preferred embodiment of one aspect of the present invention, a ramp having a top surface over which vehicles such as wheelchairs may travel to facilitate entrance to, exit from, or travel within a building, is made up of one or more sectional precast concrete ramp portions disposed adjacent to one another in an abutting relation thereto, each ramp portion having a planar top surface with a predetermined continual gradual slope extending down to a level surface upon which the ramp sits. In further accord with this aspect of the present invention, a transitional slab of precast concrete may be provided having a leading edge disposed at the level surface upon which the ramp rests, and having a trailing edge which interfaces with a first one of the sectional ramp portions. In still further accord with this aspect of the present invention, a switch platform formed of precast concrete may be disposed at predetermined intervals in the ramp on one or more sectional ramp portions adjacent to and in abutting relation therewith, the switch platform having a level top surface with no slope.

In accordance with a preferred embodiment of a second aspect of the present invention, apparatus comprising a form for facilitating the fabrication of each of the concrete sectional ramp portions includes an inner bulkhead disposed on the top surface of a base, the base rests on a level planar work surface such as a floor of a work area. The base extends out from under the sides of the bulkhead. The bulkhead has a top planar surface with a predetermined slope, and is generally rectangular in shape, the slope of the top surface of the bulkhead is in a downward direction from a rear vertical planar surface of the bulkhead towards a front planar vertical surface of the bulkhead, the bulkhead also having a pair of planar side vertical surfaces.

The form also includes a multiple of inserts, each insert having a flat upper surface that rises to a predetermined height above the top surface of the base. The inserts encircle a portion of the perimeter of the bulkhead, and have an inner edge of the upper surface disposed adjacent to and in an abutting relation to the sides of the bulkhead. A number of inserts are provided that vary in the amount of height that the insert upper surface rises above the base. Such variation in height is achieved either through providing a number of different inserts having different fixed vertical heights, or providing a number of inserts having identical vertical heights and which may be stackable on top of each other.

The form also includes four outer panels having planar vertical surfaces that encircle the perimeter of the inserts and the bulkhead. The panels are disposed such that their vertical planar surfaces are adjacent to and in an abutting relation to an outer edge of the upper surface of the inserts. The four panels provided include a rear panel and a front panel, the rear panel being of a greater vertical height than the front panel, along with a pair of side panels having a gradual reduction in height from the interface of the side panels with the rear panel down to the interface of the side panels with the front panel.

As assembled, the form creates a cavity therewithin in the shape of a sectional ramp portion. Sectional ramp portions that differ only in the vertical height of the top surface thereof may be fabricated by changing the height of the insert used within the form. This allows variation in the height or "depth" of the concrete forming the vertical sides of the sectional ramp portion. Apparatus (e.g., an angular wedge disposed under the base) is provided to tilt the assembled form in a rearward direction in an amount such that the top edges of the front and rear panels and two side panels are all at an equal height above the level surface upon which the form rests. This has the effect of placing the top surface of the bulkhead in the same horizontal plane as that of the level surface upon which the form rests. A cementitious mix in a non-hardened or slurry form is then poured into the cavity to fill the cavity up to the top edges of the four side panels. Steel reinforcers and/or heaters may be disposed in the cementitious mix while it is in slurry form. When the mix has sufficiently hardened, the tilting apparatus is removed, and the form is disassembled and the resulting ramp section is removed.

In further accord with this second aspect of the present invention, a second form is provided which facilitates the fabrication of the concrete switch platform. The form for the switch platform is similar in construction in all aspects to that of the form for the ramp portion hereinbefore described, except for the fact that now the top surface of the bulkhead is not designed to be tilted or sloped, but instead resides in a horizontal plane that is parallel to that of the level surface upon which the form rests. Also, the four side panels all rise to the same vertical height above the level surface upon which the form rests.

In still further accord with this second aspect of the present invention, a form for facilitating the fabrication of the transitional slab portion is provided. The transitional slab form includes four vertically planar panels which are assembled into a generally rectangular shape. Three vertical side panels are disposed normal to the level surface upon which the transitional slab form rests, whereas one vertical side panel is disposed at an acute angle relative to the normal with respect to the level surface upon which the transitional slab form rests. Such vertical angular slope on one of the side panels allows the corresponding planar surface of the resulting concrete slab to be oriented properly in a flush abutting relation to the corresponding concrete ramp section adjacent thereto.

DETAILED DESCRIPTION OF THE PREFERRED EMBODIMENTS

Figure 1:
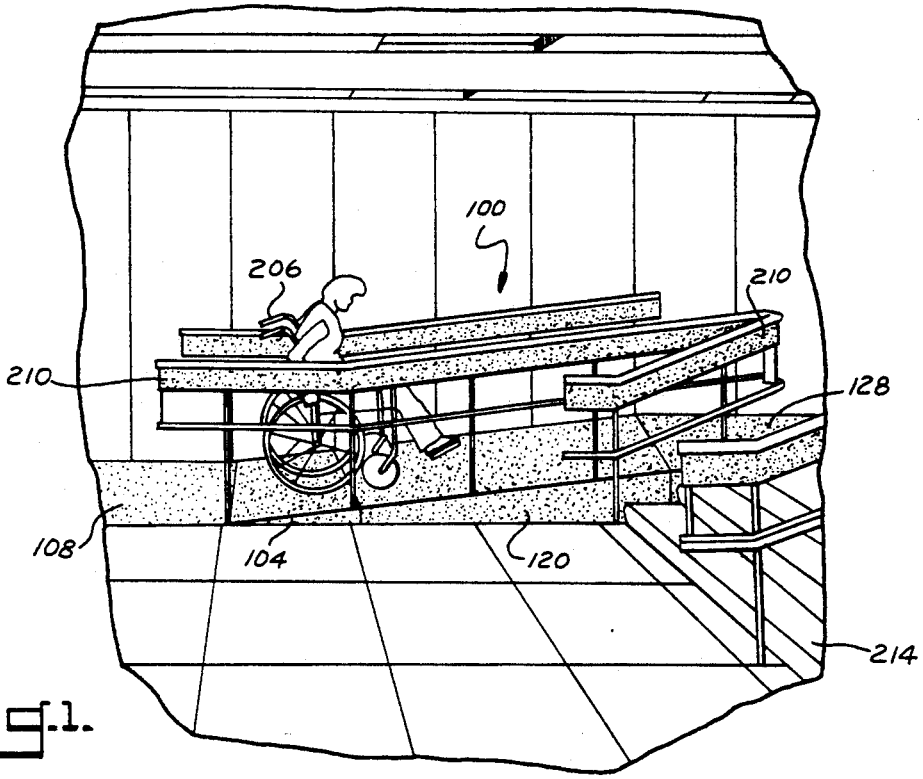
FIG. 1 is a perspective view of a ramp in accordance with the present invention disposed in proximity to a building and being traversed by a physically challenged person traveling in a wheelchair.

Referring to the drawings in detail, an exemplary embodiment of a ramp for the physically challenged comprised of three different types of sectional portions is shown and generally designated by the reference numeral 100. A first type of section is a transitional slab 104, which is disposed at the interface of the ramp 100 with a level surface 108 such as a floor or earth ground. The transitional slab 104 is disposed such that its upper surface 112 slopes upwardly from the interface of its leading edge 116 with the level surface 108. A second type of section is a ramp portion 120, which has a sloping upper surface 124. One or more ramp portions 120 may be disposed adjacent to one another in an abutting relation to each other. A third type of section is a switch platform 128, which has a level upper surface 132 (i.e., zero slope).

Another aspect of the invention involves the forms utilized for fabricating the three different types of sections comprising the ramp. A first type of form 136 is used to fabricate the transitional slab 104, and comprises four pieces 140-146 of steel arranged together in a rectangular form and laid on top of a level surface 150 such as, e.g., a floor of a work area. A second type of form 154 is used to fabricate the ramp portions 120 of the ramp 100. The ramp portion form 154 comprises a bulkhead 158, outer panels 162, and a set of inserts 166 having varying height. The inserts 166 vary the depth at which the concrete is poured, thereby varying the depth of the resulting sides of the ramp portions 120. A top surface 170 of the bulkhead 158, along with top edges of two of the outer panels 162, are sloped downwardly from the rear of the bulkhead towards the front of the bulkhead so as to accommodate the desired sloping upper surface of the ramp portion 120. Apparatus 174 (e.g., a "wedge") is used to elevate the front portion of the assembled form 154 so as to place the upper surface 170 of the bulkhead 158, along with the top edges of all four panels 162, in horizontal planes that are parallel to the plane of a level surface 178 upon which the form 158 rests.

A third type of form 182 is used to fabricate the switch platform 128 and is similar in most respects to the form 154 for the ramp portion 120, except for the fact that an upper surface 186 of a bulkhead 190 of the form 182 for the switch platform is not sloping, but instead is in a horizontal plane that is parallel to the plane of a level surface 194 upon which the form 182 rests. Also, four panels 198 surrounding the bulkhead all rise to the same vertical height above the level surface upon which the form rests.

Referring to FIG. 1, there illustrated in perspective is a ramp 100 in accordance with the present invention located either outside of a building to allow access to/-from the building, or located within the building to provide means for traveling therewithin. Illustrated therein is a physically challenged person in a wheelchair 206 traversing up to a switch platform 128 by means of a sloping ramp portion 120. Guardrails 210 are provided that are mounted to the ramp section for assisting the traveler. Disposed next to the ramp section are conventional steps 214.

Figure 2:
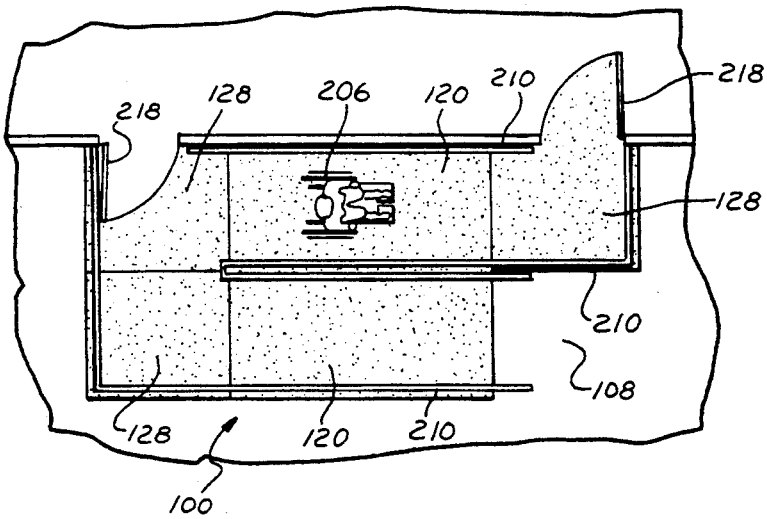
FIG. 2 is a top plan view of a different embodiment of the ramp of the present invention disposed in proximity to an entrance/exit of a building.

FIG. 2 illustrates a top plan view of another exemplary embodiment of the ramp 100 according to the present invention. In this case, the person in the wheelchair 206 is traversing from a first level platform, up a sloping ramp portion 120 to a second level platform comprising one or more switch platforms 128, and then up a second ramp portion 120 up to a third level platform comprising one or more switch platforms 128. The level platforms (a.k.a., "switch" platforms 128) are provided at various intervals such as, e.g., at entrances through doors 218, or wherever a ramp changes direction. Thus, the physically challenged person in FIG. 2 is traversing up the second sloping ramp portion 120 in an effort to obtain entrance through a doorway 218. Guardrails 210 are provided for assistance.

Figure 3:
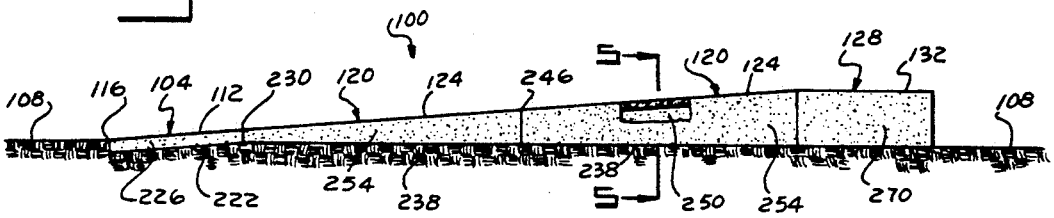
FIG. 3 is a side view, partially cut away, of a portion of the ramp of FIGS. 1 or 2.

Referring now to FIG. 3, there illustrated is a side view, partially cut away, of the three different types of ramp sections which comprise the ramp 100 of the present invention. A level horizontal surface 108 such as a floor or earth ground is illustrated. A first type of ramp section denoted a "transitional slab" 104 is generally rectangular in shape and is fabricated using the form 136 of FIG. 7, described in greater detail hereinafter. The transitional slab 104 comprises a solid piece of concrete having horizontal upper and lower surfaces 112, 222 residing in parallel planes, and having three sides comprising surfaces which are exactly transverse to the upper and lower surfaces 112, 222.

A fourth side 230 has a surface which is not exactly transverse to the upper and lower surfaces 112, 222, but instead is tilted slightly outwardly at an angle of, e.g, five degrees. This is because, as can be seen from FIG. 3, the transitional slab 104 is disposed with respect to the level surface 108 such that the upper and lower planar surfaces of the slab are tilted at an angle which equals the angle of the upper surface of the adjacent ramp portions 120, such angle of the ramp portions being described in greater detail hereinafter.

To accommodate such placement of the transitional slab, a minimal amount of site excavation must initially be performed such that a leading edge 116 of the upper surface 112 of the transitional slab 104 is flush with the level surface 108. This necessitates the leading edge of the bottom surface 222 of the transitional slab to be buried beneath the level surface 108. Such "tilting" of the transitional slab requires the approximate five-degree tilt outwardly on the facing surface 230 directly opposite to that buried such that the surface 230 can mate "flush" with a corresponding transverse surface 234 of a first ramp portion 120.

Disposed adjacent to and in abutting relation to the transitional slab 104 is a first ramp portion 120. This ramp portion, as well as other similarly described ramp portions hereinafter, has an upper surface 124 which is sloping with respect to the horizontal plane of the level surface 108. As described hereinbefore, at the interface of the ramp portion 120 with the transitional slab 104, the ramp portion has a facing surface 234 that is transverse to the plane of the level surface 108. It can also be seen from FIG. 3 that a plane passing through a bottom surface 238 of the ramp portion is equal to the plane of the level surface upon which the ramp portion rests. Thus, the slope of the upper surface 112 of the transitional slab 104 equals the slope of the upper surface 124 of the ramp portion 120. However, the use of a transitional slab is not required in the broadest scope of the present invention. Instead, the first ramp portion 120 may be disposed at the desired site so that its front vertical surface 234 interfaces with the level surface 108, in light of the teachings herein.

At the interface of the ramp portion 120 with the transitional slab 104, the ramp portion has a top-to-bottom thickness of, e.g., four inches. Such finite amount of thickness at the leading edge of this first ramp portion is required to avoid the concrete from breaking off in pieces at that end of the ramp portion. It is to be noted that four inches is an exemplary thickness of the concrete of this first ramp portion; other thicknesses may be employed, if desired, without departing from the scope of the present invention.

The distance between the front surface 234 of the ramp portion which interfaces with the transitional slab and a rear facing surface 242 which interfaces with a second ramp portion 120 defines the length of the ramp portion. In a preferred embodiment of the present invention, the length equals nine feet. However, such length is purely arbitrary and is not critical to the broadest scope of the present invention. The length was chosen based on the form 154 used to fabricate the ramp portion 120, in accordance with the present invention, as described in detail hereinafter with respect to FIGS. 8-11. The upper surface 124 of the ramp portion slopes upwardly from left to right in FIG. 3 in an amount equal to one inch of rise per twelve inches of length. This results in a slope of approximately five degrees. Such slope is dictated by the requirements of the Americans with Disabilities Act ("ADA"), discussed hereinbefore. Thus, with a ramp sectional length of nine feet and a slope of one inch per foot, a vertical height of a rear trailing edge 246 of the first ramp portion is thirteen inches.

A third type of ramp section illustrated in FIG. 3 is that of a switch platform 128. The switch platform comprises a level platform having a level (as opposed to sloping) upper surface 132. Such switch platforms are required in different instances: for example, the ADA requires that a level platform be provided at intervals of sloping ramp sections 120 not exceeding thirty-two (32) feet, or wherever a ramp changes direction and slope, and at the top and bottom of sloping ramp sections. With a nominal length of nine feet for each of the sloping ramp sections illustrated in FIG. 3, it is to be understood that, given the ADA requirements of no more than thirty-two feet of ramp sections before installation of a switch platform, a third sloping ramp section 120 could have been disposed following the second ramp section of FIG. 3. However, for illustrative purposes, only two sloping ramp sections are shown in FIG. 3.

Note that construction of the ramp of FIGS. 1-3 in sections in accordance with the present invention, and placement of the sections adjacent to and in abutting relation therewith, allows for expansion between the sections to occur without risk of damaging the sections or the building.

Figure 4:
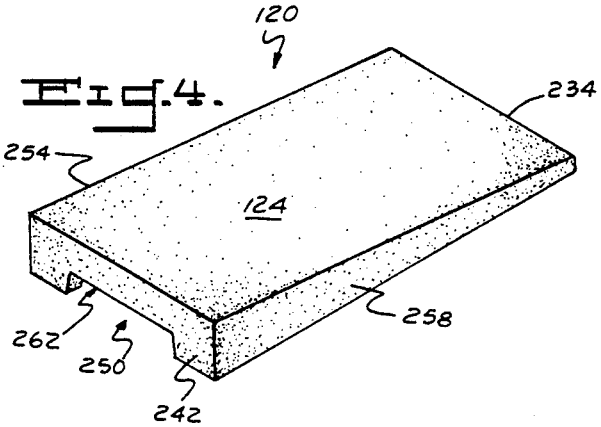
FIG. 4 is a perspective view of a portion of the ramp of FIG. 3 comprised of a precast concrete sectional ramp portion having a sloping top surface.
Figure 5:
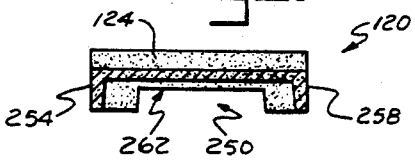
FIG. 5 is a cross section of the sectional ramp portion of FIG. 4 taken through the lines 5—5 of FIG. 3.

Referring to FIG. 4, there illustrated in perspective view is a ramp portion 120 of FIG. 3 having a sloping upper surface 124. FIG. 5 is a cross-sectional illustration of the sloping ramp portions 120 of FIG. 3. From both FIGURES it can be seen that a ramp portion does not comprise a solid block of concrete in the exemplary embodiment described herein. Instead, each ramp portion 120 has a hollow, air-filled internal section 250, so as to reduce the overall weight of the ramp portion. The two sides 254, 258 of the ramp portion comprise solid concrete, while the front and rear vertical surfaces 234, 242 of the ramp portion have an "archway" 262 that provides access to the internal hollow 250 of the ramp portion. For example, if the ramp portion has a heater disposed therein for controlling the temperature of the concrete ramp portion (as described in detail hereinafter with respect to FIG. 10), a connector cord for the heater would protrude into the hollow for connection to a heater of an adjacent ramp portion. The archway 262 allows someone to connect the heater cords from the respective ramp portions 120 together so as to effectuate an electrical connection therebetween. It is to be understood, however, that such archway 262 is purely exemplary and is not considered to be within the broadest scope of the present invention. Thus, the archway 262 may be eliminated, if desired.

Figure 6:
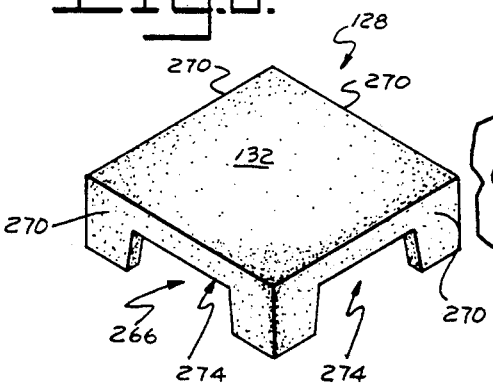
FIG. 6 is a perspective view of a switch platform portion of the ramp of FIG. 3.

In FIG. 6 is illustrated a perspective view of a switch platform 128 of FIG. 3. The switch platform has a generally rectangular upper surface 132 with zero slope, i.e., the upper surface 132 resides in a horizontal plane that is parallel to the level surface 108 upon which the switch platform and, for that matter, the remainder of the ramp portions 120 of FIG. 3, rest. The switch platform also has an internal hollow section 266 to reduce the overall weight of the switch platform. However, in contrast to the ramp portion 120 described hereinbefore, each of the four vertical side surfaces 270 of the switch platform may or may not have an "archway" 274 for facilitating access to the internal hollow 266 of the switch platform. As a rule, an archway 274 is provided on a vertical side surface 270 of a switch platform 128 at those surfaces 270 which are intended to interface with a front or rear surface 234, 242 of a corresponding ramp portion 120. Since that corresponding ramp portion front or rear surface 234, 242 itself will have an archway 262, the archway 274 in the switch platform vertical side surface 270 is intended also to provide access to the internal hollow of both the switch platform and the ramp portion. Thus, in FIG. 6, the switch platform 128 shown having archways 274 on each of two adjacent vertical side surfaces 270 indicates that the overall ramp structure contains an "L"-shaped portion.

Figure 7:
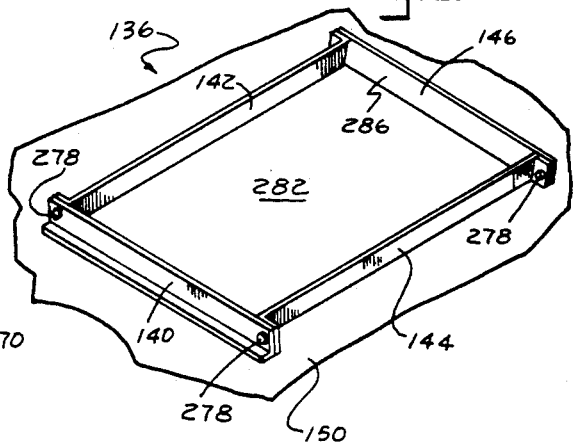
FIG. 7 is a perspective view of a form for fabricating a transitional slab portion of the ramp of FIG. 3.

Referring now to FIG. 7, there illustrated is the form 132 used to fabricate the transitional slab 104 of FIG. 3. The form 132 may comprise four "strips" 140-146 of material such as, e.g., eleven-gauge sheet metal. The strips are connected together at ends thereof by any one of a number of means 278; for example, nuts/bolts, welding, or clamps.

The assembled form 136 is placed on a level surface 150 such as a floor of a work area. On the floor 150 of the work area and within an inner cavity 282 bounded by the surfaces 140-146 of the form may be placed a sheet of plastic (not shown) or other suitable material, as this is where the concrete will be poured. Exemplary dimensions of the transitional slab form 136 of FIG. 7 include a width dimension of four feet, eight inches, a length dimension of four feet and a height dimension of four inches. The height dimension is purely arbitrary and is chosen to match the height of the front vertically planar surface 234 of a first sloping ramp portion 120 to which the transitional slab 104 will interface. The length dimension is also arbitrary, while the width dimension is dictated in part by the requirements of the ADA. The ADA requires that any portion of a ramp 100 have a width of no less than four feet between any guardrail 210 disposed along the edges of any type of ramp section. Thus, the width dimension of four feet, eight inches allows for four extra inches on each side of the transitional slab 104 to place guardrails 210.

The two surfaces of the sides 142, 144, along with one surface of the side 140 are all exactly transverse (i.e., ninety degrees) with respect to the level surface 150 upon which the form rests. A surface 286 of the side 146, opposite side 140, is not exactly transverse to the level surface 150, but, instead, is tilted slightly outwardly at an angle of approximately five degrees with respect to the normal to the level surface. Thus, the "tilted" vertical side surface 286 of the form 136 is at an obtuse angle with respect to the portion of the level surface within the cavity 282. Such slight offset angle is required because, as described hereinbefore with respect to FIG. 3, the resulting concrete transitional slab 104 is disposed at the intended site of the ramp 100 such that its upper surface 112 is tilted at an angle with respect to the level surface 108 upon which the remainder of the ramp sections sit. The amount of tilt angle matches the slope of the upper surface 124 of the ramp portions 120. The slightly angled vertical side surface 286 of the transitional slab form 136 ensures that the corresponding side surface of the resulting concrete transitional slab 104 interfaces flush with the corresponding transverse surface 234 of the first sloping ramp section 120.

Once the form 136 of FIG. 7 has been assembled and placed on the desired work area level surface 150, concrete (not shown) in a non-hardened, or slurry, form is poured into the cavity bounded by the four sides 140–146. The concrete is poured up to the top edge of each of the four sides 140–146. The type of concrete utilized in an exemplary embodiment of the present invention is described in more detail hereinafter with respect to the formation of the sloping ramp sections.

Figure 8:
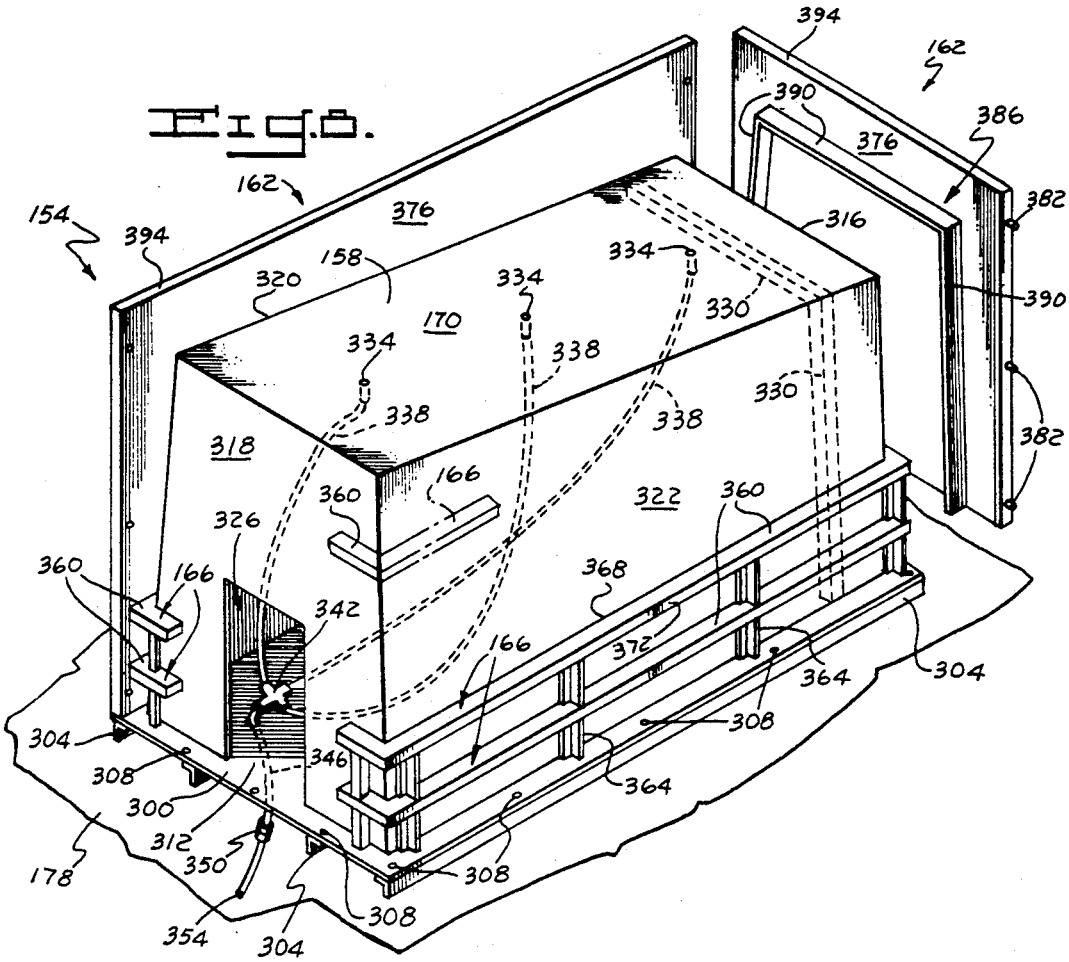
FIG. 8 is a perspective view, partially exploded, of a portion of a form for fabricating the ramp portion having a sloping top surface of FIG. 4.

Referring now to FIG. 8, there illustrated is a perspective view, partially exploded and partially assembled, of a form 154 for fabricating a plurality of the sloping ramp portions 120 shown in perspective in FIG. 4. The form includes a base 300 comprising a generally rectangular piece of metal, for example and without limitation, eleven-gauge sheet metal, one-eighth inch thick. Welded to a bottom surface of the base 300 are a plurality of strips 304 of two-inch angle iron. The angle iron 304 may be attached on 16-inch centers and may span either the long or short dimension of the base 300, or may be oriented in some other manner. The angle irons provide support for the base and make it easier to elevate the base, in accordance with the present invention as described in more detail hereinafter, or to transport the entire form. At a number of locations on the outer perimeter of the base upper surface are disposed corresponding threaded through holes 308 formed in the base material. The holes 308 are used to secure to the base, by means of hexhead bolts 310 (FIG. 11), side panels 162, as described hereinafter in more detail.

Located on the base upper surface 312 and within the periphery thereof is a three-dimensional bulkhead structure 158. The bulkhead 158 comprises an upper surface 170, which is generally rectangular in shape, along with four side vertical surfaces 316–322. The bulkhead forms a "house-like" structure having a hollow interior. An "access" door 326, which is a cutout in the rear surface 318 of the bulkhead, provides access to the hollow interior.

The upper surface 170, along with the four side surfaces 316–322, of the bulkhead may all comprise, e.g., eleven-gauge sheet metal that is welded together. The bottom edge of the four side surfaces of the bulkhead are welded to the upper surface 312 of the base 300. Shown in phantom are two of a plurality of "ribs" 330 that are welded to the insides of the upper surface 170 and four side surfaces 316–322 of the bulkhead. The ribs 330, which may comprise strips of two-inch angle iron, provide load-bearing support for the bulkhead 158.

Three small-diameter holes 334 are formed in the upper surface 170 of the bulkhead. A rubber air hose 338 is connected to each of the corresponding holes. The hoses 338 are routed within the hollow interior of the bulkhead, as illustrated in phantom. The three air hoses are connected to a single connector 342, which itself is connected to a single air hose 346 routed to an air coupler connector 350 located underneath the base. Connected to the air coupler connector 350 is another air hose 354 which leads to an air compressor (not shown). The compressor provides compressed air through the air hoses 338, 346, 354 to the three holes 334 in the upper surface 170 of the bulkhead 158. The compressed air aids in the removal of the resulting hardened concrete ramp portion by breaking any seal between the concrete disposed on the bulkhead upper surface 170 and the upper surface 170 itself. Such procedure is described in greater detail hereinafter with respect to an example of the formation of a sloping ramp portion 120 in accordance with the present invention. However, it is to be understood that the air holes 334, hoses 338, 346, 354 and compressor are not required for the broadest scope of the present invention.

As can be seen from FIG. 8, the upper planar surface 170 of the bulkhead 158 slopes downwardly in a gradual progression from the rear side surface 318 towards the front side surface 316 of the bulkhead. The amount of slope is equal to one inch of vertical displacement per twelve inches of length. That is, the slope of the upper surface 170 of the bulkhead matches that of the upper surface 124 of the resulting ramp portion 120.

Also, as can be seen from FIG. 8, each of the four side surfaces 316–322 of the bulkhead is not disposed transverse or normal to the upper surface 312 of the base 300; but, instead, is tapered slightly "inward" as the respective surface 316–322 rises up from the base 300 towards the bulkhead upper surface 170. The taper aids in the removal of the resulting hardened concrete ramp portion from the bulkhead. The taper may be on the order of one degree or so with respect to an axis normal to the base upper surface 312.

Also illustrated in FIG. 8 are several "inserts" 166. As can best be seen in FIG. 9, each insert 166 comprises a "U-shaped" piece of, e.g., eleven-gauge sheet metal, having a flat upper surface 360. Extending vertically downward from the underneath of the insert upper surface are a number of "legs" 364 comprising, e.g., two-inch steel angle iron disposed on 24-inch centers. As shown in FIG. 8, the inserts 166 may be stacked one on top of each other; i.e., a first insert 166 rests on the base upper surface 312, while a second insert 166 rests on the upper surface 360 of the insert disposed therebelow. An inner edge 368 of the surface 360 of the insert is disposed adjacent to and in abutting relation with the corresponding side surfaces 316–322 of the bulkhead 158. As will be more appreciated hereinafter, the upper surface 360 of the uppermost stacked insert 166 (regardless of how many inserts are stacked) comprises the surface which constrains the concrete of the resulting ramp section. The approximate positioning of a highest insert 166 that the bulkhead 158 can accommodate is shown in phantom in FIG. 8.

As can be seen clearly in FIG. 8, the inserts 166 are designed such that the insert upper surface 360 spans the entire length of the side 320, 322 of the bulkhead 158 having the longest length. The insert upper surface then "wraps around" the bulkhead and spans only a portion of both the front and rear vertical side surfaces 316, 318 of the bulkhead. Thus, for each of the different vertical levels achieved by the inserts, a pair of inserts 166 is required to be located adjacent the bulkhead side surfaces 316–322.

Figure 9:
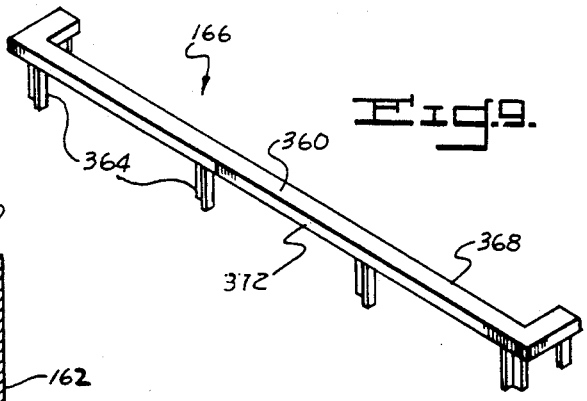
FIG. 9 is a perspective view of an insert that integrally forms a portion of the form of FIG. 8.

It can be seen from FIG. 8 that the height of the insert upper surface 360 above the base upper surface 312 determines the depth of the side portions of the resulting concrete ramp portion 120. Thus, by providing a number of different inserts of varying height, a number of different size ramp portions can be obtained using the form 154 illustrated in FIG. 8. Now since the length of the resulting ramp portion is nine feet and its slope is one inch per lineal foot, it follows that, in order to fabricate a number of such ramp portions having varying depth of size, the inserts must vary in height by nine inches. To accomplish this, two types of inserts are provided: a first "stackable" type, as illustrated in FIGS. 8 and 9, each having a height of nine inches; or, a second "dedicated" type, formed with legs 364 having the desired height of the insert upper surface 360 with respect to the base upper surface 312. The "stackable" type inserts 166 are less expensive to manufacture because they require less material. They are also easier to handle. Nonetheless, the specific type of insert is not critical to the broadest scope of the present invention. However, because of the "tapered" sides 316–322 of the bulkhead, the inserts that are disposed progressively higher have slightly larger areas of the upper surface 360 than those below. This is to meet the requirements that the inner edge 368 of the insert upper surface 360 be abutting the side surface 316–322 of the bulkhead, and an outer edge 372 of the insert upper surface 360 be abutting a corresponding surface 376 of an outer panel 162.

Further, it can be seen that, for each desired depth of concrete ramp portion 120, a pair of inserts 166 are required—one disposed on each of the longest sides 320, 322 of the bulkhead 158. In an exemplary embodiment of the present invention, the height of the bulkhead is chosen such that six different size ramp portions may be fabricated therefrom, thereby requiring five pairs of inserts 166. It follows that the ramp portion having the "deepest" sides (i.e., the largest vertical height) is fabricated with no inserts disposed adjacent the bulkhead. That is, the concrete is poured all the way down to the base upper surface 312.

The form 154 for fabricating the ramp portions also includes four outer side panels 162, each panel comprising a piece of, e.g., eleven-gauge sheet metal having a smooth-textured inner surface 376 which faces the corresponding side 316–322 of the bulkhead. For clarity, only two of the outer panels are illustrated in FIG. 8; one attached to the base 300, and a second panel shown apart from the bulkhead 158. Each panel 162 attaches to the base by means of, e.g., a half-inch threaded hexhead bolt (not shown) which is secured into the threaded holes 308 formed in the upper surface 312 of the base. The panels attach to one another along the sides thereof also by means of hexhead bolts 382. Alternatively, the panels may be connected to one another by a form binder clamp (not shown), available from Del Zotto Manufacturing, Inc., located in Duluth, Minn. As described hereinbefore, the inner surface 376 of each panel 162 abuts an outer edge 372 of the upper surface 360 of the corresponding insert.

The panel 162 facing the front surface 316 of the bulkhead has an inner surface 376 to which is welded a "shelf" 386, comprising three strips 390 of, e.g., eleven-gauge sheet metal. The strips 390 are approximately four inches wide, which is the same width as that portion of the upper surface 360 of the inserts 166 abutting the front surface of the bulkhead. Although not shown, the panel 162 facing the rear surface 318 of the bulkhead has a similar "shelf" 386 welded to an inner surface 376 of the panel 162. The two side panels 162 facing the corresponding sides 320, 322 of the bulkhead 158 do not have such a shelf welded to an inner surface 376 thereof. The "shelf" 386 constrains the concrete to form the "archways" 262 located at the front and rear surfaces 234, 242 of the concrete ramp portion 120, as illustrated in FIGS. 4 and 5. It is to be understood, however, that if no "archways" 262 are desired in the ramp portions 120, the "shelf" 386 can be eliminated from both the front and rear panels 162. However, in this case, no "access door" 326 in the rear side surface 318 of the bulkhead is allowed, since now the concrete slurry will now travel to the "access door" location on the side of the bulkhead.

When the four side panels 162 are assembled to the remainder of the form, any point measured along a top surface 394 of each of the four side panels 162 is equidistant from the bulkhead upper surface 170, as measured vertically. In an exemplary embodiment, this distance is approximately four and one-half inches. This height determines the thickness of the upper surface 124 of the resulting concrete ramp portion 120, and is constant regardless of which of the six different size ramp portions 120 are formed.

The form 154 of FIG. 8 for fabricating the sloping ramp portions is assembled by first positioning the base 300 and bulkhead 158 on a level surface 178 such as a floor of a work area. Next, the pair of inserts 166 which corresponds to the desired height of the resulting concrete ramp portion 120 are placed on the base upper surface 312 and adjacent to and in abutting relation to the side surfaces 316–322 of the bulkhead. For example, if it is desired to fabricate the first ramp portion 120 of FIG. 3, then five of the stackable-type inserts 166 must be disposed on top of each other. However, for fabricating the ramp portion 120 having the greatest height, no inserts 166 are used. Once the inserts are in place, the four outer panels 162 are attached to the base and to one another.

As a result, a cavity 400 is formed into which concrete 404 in non-hardened form may be poured, as described hereinafter. The cavity 400 is defined by the bulkhead upper surface 170 and a portion of the four side surfaces 316–322 of the bulkhead, a portion of the inner surfaces 376 of each of the four outer panels 162 together with the "shelf" 386 of the front and rear outer panels 162, and the upper surface 360 of the pair of inserts 166. The cavity 400 so defined forms the "hollow" portion 250 internal to the resulting ramp portion 120, the "hollow" being underneath the upper surface 124, and being accessible by the "archways" 262.

Figure 11:
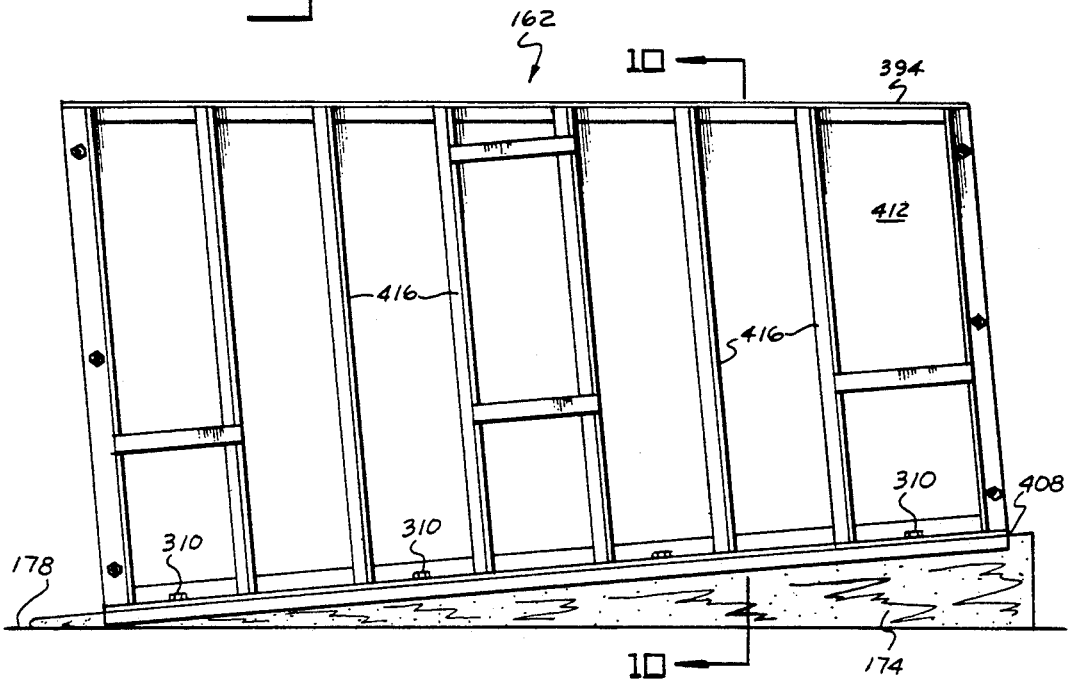
FIG. 11 illustrates a side view of the form of FIG. 8 when completely assembled and elevated at one end thereof so as to properly orient the form for facilitating fabrication of the concrete ramp portion having the sloping top surface of FIG. 4.

However, if concrete 404 were to be poured into the cavity 400 as such, the concrete slurry would tend to flow downward towards the front surface 316 of the bulkhead 158. To alleviate such problem, the front end of the form 154 is elevated by means 174 such as, e.g., a pair of wooden wedges disposed underneath the base, as illustrated in FIG. 11. The wedges 174, which may comprise timber such as railroad ties, have an upper surface 408 having a slope which equals that of the upper surface of the bulkhead (e.g., approximately five degrees). It is to be understood, however, that other means for raising the front of the bulkhead may be utilized without departing from the broadest scope of the present invention. For example, the front end may be elevated simply by means of a crane (not shown). Through use of such means 174 for elevating the bulkhead, the naturally-sloped upper surface 170 of the bulkhead and top surfaces 394 of the two outer side panels 162 are now brought into horizontal planes which are parallel to that of the level surface 178 upon which the entire form 154 rests.

FIG. 11 also illustrates that an outer surface 412 of the side panels is supported by two-inch steel angle iron strips 416 on sixteen-inch centers welded to the outer surface 412 of the eleven-gauge sheet metal used as the panel surface. Each of the four outer panels 162 has similar angle irons 416 welded thereto for support.

Once the form 154 has been assembled, and has been elevated as illustrated in FIG. 11, it is now ready to have concrete 404 poured into the cavity 400 therein. In an exemplary embodiment of the present invention, the concrete 404 comprises a High Early Strength Portland Cement, available from the Glens Falls Cement Company, Inc., located in Glens Falls, N.Y. The cement is mixed with water, stone, gravel, and an air entrainment chemical in a standard cement mixer (not shown). The mixer may comprise the Stow, Model CM9, nine-cubic-foot mixer, available from the Stow Manufacturing Company of Binghamton, N.Y.

The different elements are mixed according to the following formula or "recipe": initially, one bag of cement is placed into the mixer along with five gallons of water and one shovelful of stone. The stone may comprise three-quarter-inch round or crushed stone. The mixture is then allowed to run for approximately one or two minutes. During this time the stone breaks up any large particles of the cement powder which may have formed. Next, five shovels of stone along with twenty shovels of gravel and a three-quarter tablespoon of an air entrainment chemical is mixed into the mixer. The mixer is then allowed to run for approximately five more minutes. The air entrainment chemical replaces any water bubbles with air bubbles to prevent freezing. The aforedescribed recipe depends upon use of a standard bag of cement weighing ninety-five pounds.

Once the concrete slurry has reached the desired texture in the mixer, it is then poured into the cavity 400. Prior to pouring, lithium grease may be spread on the upper surface 170 of the bulkhead 158. A plastic sheet may then be placed on top of the grease. A form oil may be rubbed on the other surfaces within the cavity. The grease, plastic and oil act as releasing agents to keep the concrete 404 from adhering to the surfaces of the cavity 400, thereby aiding in the removal of the resulting concrete ramp portion when hardened. It has been found that it requires approximately six "batches" of concrete to completely fill the cavity 400 when a ramp portion 120 having the shallowest sides is desired. For each successive size of ramp portion, the number of "batches" increases by approximately three. The concrete may be loaded into the cavity from the cement mixer through use of a front-end loader.

Figure 10:
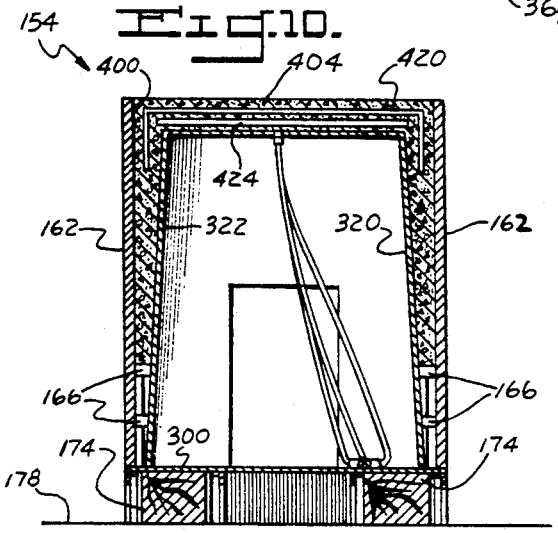
FIG. 10 is a cross-sectional view of the form of FIG. 8 when completely assembled, taken along the lines 10—10 of FIG. 11, illustrating a cavity into which concrete in a liquid form may be poured.

FIG. 10 illustrates a cross-sectional view of the form 154 for fabricating the ramp portion 120, taken along the lines 10—10 of FIG. 11. Typically the concrete 404 takes about twenty-four hours to sufficiently harden. Shortly before the concrete is poured into the cavity, steel reinforcing means 420 may be placed in the cavity 400. The steel reinforcing means 420 may comprise a "cage", comprising three-eighths inch diameter steel reinforcing rods welded together. Also, if desired, a heater 424 may be placed in the cavity. The positioning of the heater 424 and cage 420 may be reversed from that shown in FIG. 10. The heater 424 may be connected to a source of electricity through use of a power cord (not shown). The power cord may protrude through the cavity through holes in the upper surface 360 in the insert 166 at the front and rear bulkhead surfaces 316, 318. After the concrete 404 is poured, "plugs" (not shown) used to facilitate the mounting of guardrails 210 to the upper surface 124 of the resulting ramp portion 120 may be inserted into the concrete. Alternatively, the guardrails may be bolted to the hardened concrete ramp portion at a later time.

FIG. 11 illustrates a side view of the assembled ramp form 154 of FIG. 8. Therein, the slope of the "wedge" portions 174 disposed underneath the base 300 can better be seen. As described hereinbefore, the wedge 174 has the effect of elevating the normally downward-sloping upper surface 170 of the bulkhead 158 and top edges 394 of the two side panels 162 to a plane that is parallel to that of the level surface 178 upon which the form 154 and wedge 174 rest.

Once the concrete has sufficiently hardened, the outer panels are removed, and the air compressor may be connected to the air coupler to provide a short (e.g., five seconds) "blast" of compressed air (e.g., ten pounds) to the bulkhead upper surface. The hardened concrete ramp portion may then be removed from the form through use of a crane.

Figure 12:
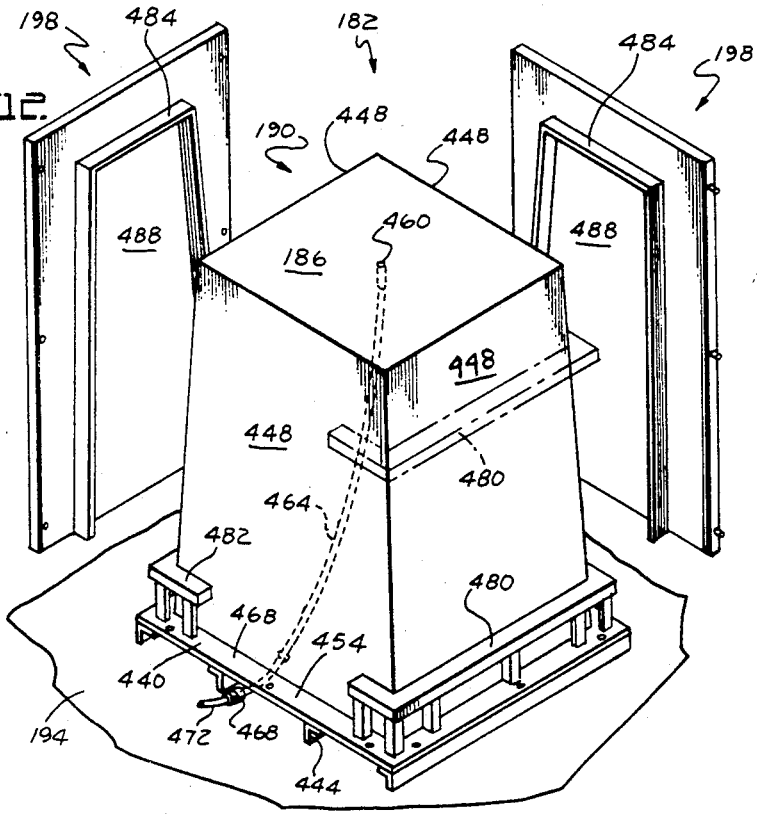
FIG. 12 is a perspective view, partially exploded, of a form for facilitating fabrication of the switch platform of FIG. 6.

Referring now to FIG. 12, there illustrated in perspective, partially exploded and partially assembled, is a form 182 used for fabricating the "switch platforms" 128 of FIGS. 3 and 5. The form 182 for fabricating the switch platforms is similar in construction in all aspects to that of the form 154 for the ramp portion 120 described hereinbefore, except that now a top surface 186 of a bulkhead 190 is not designed to be tilted or sloped, but instead resides in a horizontal plane that is parallel to that of a level surface 194 upon which the form 182 rests. Thus, it follows from the foregoing that the four side panels 198 provided for the form for fabricating the switch platform all rise to the same vertical height above the level surface 194, in contrast to the panels 162 for the ramp form 154 which were of different height and of sloping characteristics. Because the switch platform 128 has a level upper surface 132, there is no need to "tilt" the form 182 prior to pouring concrete within a cavity in the form.

The form comprises a base 440 made of, e.g., eleven-gauge sheet metal. An underside of the base 440 has welded thereto a number of strips 444 of two-inch angle iron. The bulkhead 190, comprising the level upper surface 186 along with four "tapered" side surfaces 48 welded together, is affixed to an upper surface 454 of the base 440 by, e.g., welding. The bulkhead upper surface 186 has a single hole 460 through which compressed air is provided. A rubber air hose 464, shown in phantom, connects within the interior of the bulkhead 190 to an air coupler 468 located on the under surface of the base 440. Another air hose 472 connects to the compressor, which provides compressed air to the bulkhead upper surface 186 to aid in the removal therefrom of the hardened concrete switch platform 128.

In a similar manner to the form 154 for fabricating the ramp portion 120, a plurality of inserts 480, 482 are provided, being either of the "stackable" or "dedicated" type. Also, four outer panels 198 are provided that surround the bulkhead and define the outer contours of the cavity for constraining concrete. However, in contrast to the form 158 for fabricating the ramp portion 120, a selected one or more sides 270 of the resulting switch platform 128 may have an "archway" 274 formed therein. The form 182 of FIG. 12 is flexible in that it allows a choice of which one or more sides 270 will have the archway 274 formed therein. To accommodate such selection, two types of outer panels 198 are provided: a first type having a "shelf" 484 formed on a surface 488 thereof; a second type without any shelf 484 formed thereon. Illustrated in FIG. 12 are two outer panels 198, each having the shelf 484 formed thereon. However, to accommodate such selectivity, four panels 198 having "shelves" formed thereon are needed. Also, four panels 198 having no shelves formed thereon are needed.

The shelf 484 is used to form the resulting archway 274 in the switch platform 128. An archway is formed so as to provide access to both the internal hollow 266 within the switch platform, and also access to the internal hollow 250 of the ramp portion 120. This difference in characteristic between the panels 198 of the form 182 for fabricating the switch platform and the form 154 for fabricating the ramp portion 120 necessitates a difference in the structure of the inserts 480, 482. That is, for those sides 270 of the switch platform where it is desired not to have an archway formed therein, the insert 480 must span the entire width of the side 448 of the bulkhead 190. This type of insert is illustrated in FIG. 12 as reference numeral 480. On the other hand, for those sides 270 of the switch platform 128 where an "archway" 274 is desired, then the insert 482 does not span the entire width of the side 448 of the bulkhead. Instead, in a similar manner to the form for fabricating the ramp portion, the insert 482 spans only a portion of the corresponding side of the bulkhead. Such insert, designated as reference numeral 482, then fits integrally with the "shelf" 484 formed on the inner surface 488 of the corresponding outer panel 198.

In a similar manner to the form 154 for fabricating the ramp portion 120, the height of the bulkhead 190 and outer panels 198 is designed such that up to six different size switch platforms 128 may be fabricated, with the difference being in the vertical height that the resulting switch platform rises above the level surface 108 upon which the switch platform 128 will be seated. Once the form 182 of FIG. 12 has been assembled with the desired outer panels 198 and inserts 480, 482, concrete in a slurry or non-hardened form is then poured into the cavity within the form. The concrete is given sufficient time to harden, the form is disassembled, and the resulting concrete switch platform is removed through use of, e.g., a crane, and also with the aid of compressed air to "release" the form from the upper surface 186 of the bulkhead.

The ramp 100 of the present invention has been described in several different embodiments as assembled into various configurations, e.g., FIGS. 1-3. However, it is to be understood that such configurations are purely exemplary; any configuration of a ramp for the physically challenged is contemplated and made possible by the present invention through use of a combination of the ramping portion having a sloping upper surface, and the switch platform having a level surface, along with the transitional slab, if needed.

The apparatus of the present invention for forming the ramp portions 120 has been described as a single form 154 that is capable of forming a plurality (e.g., 6) of different size ramp portions simply by means of using inserts 166. However, it is to be understood that the present invention contemplates the use of a plurality of different forms 154 that differ in the height of the bulkhead 158. That is, each form 154 is dedicated to producing only one size ramp portion 120, that size being determined by the height of the bulkhead. In such case, the inserts may be eliminated, if desired. Having a plurality of forms 154 of different sizes facilitates "mass production" of ramp portions 120. A similar situation is contemplated for the form 182 for fabricating the switch platforms 128.

Also, the forms 154 and 182 for fabricating the ramp portions 120 and switch platforms 128, respectively, have been described as each comprising a bulkhead 158, 190. The bulkheads are used to form the internal cavities 250, 266 in the respective concrete portions. However, if ramp portions 120 and switch platforms 128 that are completely solid are desired, then the bulkheads may be eliminated. The resulting forms 154, 182 would then comprise the base 300, 440 and the outer panels 162, 198. The form 154 for fabricating the ramp portion 120 would still be elevated as described herein for achieving the proper "slope" to the upper surface 124 of the ramp portion 120.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. Apparatus for forming a concrete ramp, comprising:

a. a ramp form, having a ramp form cavity for constraining concrete therewithin to conform to the contours of the ramp form cavity, the ramp form including:

i. a ramp base disposed on a level surface and having an upper surface disposed in a horizontal plane parallel to that of the level surface; and ii. a pair of ramp side panels along with a ramp front panel and a ramp rear panel, each of the four ramp panels having a ramp panel planar surface and having a top edge that is indicative of a predetermined rise in height of each of the four ramp panels above the ramp base upper surface, the top edge of each of the pair of ramp side panels sloping downwardly in height from the ramp rear panel toward the ramp front panel such that a top edge of the ramp rear panel is at a greater vertical height above the level surface than a top edge of the ramp front panel; and b. means for elevating the ramp form to a predetermined height at a front end of the ramp form located at the ramp front panel such that the normal downward sloping top edge of each of the pair of ramp side panels, along with the top edges of the ramp rear panel and ramp front panel, are all in a horizontal plane parallel to that of the level surface upon which the ramp base is disposed.

2. The apparatus of claim 1, further comprising:

a ramp bulkhead, disposed on top of the ramp base upper surface, having a ramp bulkhead planar upper surface and having a pair of ramp bulkhead planar side surfaces and front and rear ramp bulkhead planar surfaces, an edge of the ramp bulkhead upper surface at the front ramp bulkhead planar surface being of a height less than that of an edge of the ramp bulkhead upper surface at the rear ramp bulkhead planar surface such that the plane of the ramp bulkhead upper surface has a constant angular slope with respect to the level surface in a downward direction from the rear ramp bulkhead planar surface toward the front ramp bulkhead planar surface, wherein the ramp panel planar surface of each of the four ramp panels is disposed at a predetermined distance from the corresponding ramp bulkhead planar side surface, front ramp bulkhead planar surface and rear ramp bulkhead planar surface of the ramp bulkhead.

3. The apparatus of claim 2, further comprising:

a ramp insert, disposed on the ramp base upper surface, having a ramp insert planar upper surface with a predetermined width and rising to a predetermined height above the ramp base upper surface, an inner edge of the ramp insert upper surface being disposed adjacent to and in abutting relation to the front and rear ramp bulkhead planar surfaces and the pair of ramp bulkhead planar side surfaces, the ramp panel planar surface of each of the four ramp panels being disposed adjacent to and in abutting relation to an outer edge of the ramp insert upper surface.

4. The apparatus of claim 1, further comprising:

a platform form, having a platform form cavity for constraining concrete to conform to the contours of the platform form cavity, the platform form including:

i. a platform base disposed on a level surface and having an upper surface disposed in a horizontal plane parallel to that of the level surface; and ii. four platform panels, each of the four platform panels having a platform panel planar surface rising to a predetermined height above the platform base upper surface, whereby the platform form is operable to form a first type of component of the concrete ramp that is adjacent to at least one of a second type of component of the concrete ramp that is formed by the ramp form.

5. The apparatus of claim 4, further comprising:

a platform bulkhead, disposed on the top of the platform base upper surface, having a platform bulkhead planar upper surface lying in a horizontal plane parallel to that of the level surface, and having four platform bulkhead planar side surfaces, wherein the platform panel planar surface of each of the four platform panels is disposed at a predetermined distance from the corresponding platform bulkhead planar side surface of the platform bulkhead.

6. The apparatus of claim 5, further comprising:

a platform insert, disposed on the platform base upper surface, having a platform insert planar upper surface with a predetermined width and rising to a predetermined height above the platform base upper surface, an inner edge of the platform insert upper surface being disposed adjacent to and in abutting relation to the four platform bulkhead planar side surfaces, the platform panel planar surface of each of the four platform panels being disposed adjacent to and in abutting relation to an outer edge of the platform insert upper surface.

7. The apparatus of claim 1, wherein the means for elevating the ramp form comprises one or more wedge portions disposed underneath the base, each of the one or more wedge portions having a lower surface disposed on top of the level surface, and having an upper surface that has an angular slope equal in amount to the slope of the top edges of each of the pair of ramp side panels.

8. The apparatus of claim 1, further comprising a transition slab form disposed on top of a level surface, the transition slab form having four side panels arranged in a generally rectangular shape, each of the transition slab side panels having a surface rising to a predetermined height above the level surface, three of the side panel surfaces being transverse to the level surface, the surface of a fourth side panel being disposed at a predetermined angle with respect to the level surface, whereby the transition slab form is operable to form a third type of component of the concrete ramp that is adjacent to the second type of component of the concrete ramp.

9. The apparatus of claim 2, wherein the pair of ramp bulkhead planar side surfaces of the ramp bulkhead and the front and rear ramp bulkhead planar surfaces of the ramp bulkhead taper at an angle with respect to the ramp base upper surface.

10. The apparatus of claim 5, wherein each of the four platform bulkhead planar side surfaces of the platform bulkhead tapers at an angle with respect to the platform base upper surface.

11. The apparatus of claim 2, further comprising air means, disposed at one or more predetermined locations in the ramp bulkhead upper surface, for providing compressed air to an underside of concrete disposed in the cavity in the ramp form.

12. The apparatus of claim 5, further comprising air means, disposed at one or more predetermined locations in the platform bulkhead upper surface, for providing compressed air to an underside of concrete disposed in the cavity in the platform form.

13. The apparatus of claim 1, wherein both the ramp front panel and the ramp rear panel have a horizontally disposed planar shelf surface attached in a transverse relation to the surface of the corresponding ramp front panel and ramp rear panel, the plane of the horizontally disposed planar shelf surface being parallel to that of the ramp base upper surface, and wherein both the ramp front panel and the ramp rear panel have a pair of vertically disposed planar shelf surfaces attached in a transverse relation to the surface of the corresponding ramp front panel and ramp rear panel and tapered at an angle with respect to the plane of the ramp base upper surface.

14. The apparatus of claim 4, wherein a selected one or more of the four platform panels has a horizontally disposed planar shelf surface attached in a transverse relation to the surface of the corresponding panel, the plane of the horizontally disposed planar shelf surface being parallel to that of the platform base upper surface, and wherein the corresponding selected one or more of the four platform panels has a pair of vertically disposed planar shelf surfaces attached in a transverse relation to the surface of the corresponding platform panel and tapered at an angle with respect to the plane of the platform base upper surface.

* * * * *